US005326002A

United States Patent [19]

Dubini

[11] Patent Number: 5,326,002

[45] Date of Patent: Jul. 5, 1994

[54] SPRAYING CAN WITH PREASSEMBLED DISPENSER VALVE

[76] Inventor: Uberto Dubini, Via Tubi, 12 - 22053 Lecco (Prov. of Como), Italy

[21] Appl. No.: 14,485

[22] Filed: Feb. 8, 1993

[30] Foreign Application Priority Data

Feb. 21, 1992 [IT] Italy ..... MI92A000396

[51] Int. Cl.[5] ..... B65D 83/14

[52] U.S. Cl. ..... 222/402.1; 222/402.24

[58] Field of Search ..... 222/394, 402.1, 402.24

[56] References Cited

U.S. PATENT DOCUMENTS

| | | | |
|---|---|---|---|
| 2,570,909 | 10/1951 | Benson et al. . | |
| 2,883,090 | 4/1959 | Remane | 222/402.24 |
| 2,900,114 | 8/1959 | Utz . | |
| 3,009,602 | 11/1961 | Raehs | 222/402.1 X |
| 3,114,483 | 12/1963 | Kappel | 222/402.24 |
| 3,121,517 | 2/1964 | Geary et al. | 222/402.24 |
| 3,158,297 | 11/1964 | Ferry, Jr. et al. | 222/402.24 X |
| 3,158,326 | 11/1964 | Remane | 222/402.24 X |
| 3,396,874 | 8/1968 | Malone | 222/402.1 |
| 3,613,728 | 10/1971 | Steiman | 222/402.24 X |
| 3,806,005 | 4/1974 | Prussin et al. . | |
| 3,830,412 | 8/1974 | Green | 222/402.24 |
| 3,933,206 | 1/1976 | Burke | 222/402.24 X |
| 3,977,576 | 8/1976 | Amabili | 222/402.1 |
| 4,078,705 | 3/1978 | Butcher | 222/402.24 |
| 4,133,461 | 1/1979 | Vercelot | 222/402.24 |
| 4,405,064 | 9/1983 | Stoody | 222/402.24 X |

FOREIGN PATENT DOCUMENTS

| | | | |
|---|---|---|---|
| 0221563 | 5/1987 | European Pat. Off. . | |
| 204383 | 9/1965 | Sweden | 222/402.24 |
| 286803 | 11/1952 | Switzerland . | |
| 763035 | 12/1956 | United Kingdom | 222/402.24 |
| 861174 | 2/1961 | United Kingdom | 222/402.24 |

*Primary Examiner*—Kevin P. Shaver

*Attorney, Agent, or Firm*—Guido Modiano; Albert Josif

[57] ABSTRACT

The spraying can with preassembled dispenser valve includes a can body with which a dispenser valve is associated. An advantageous feature is constituted by the fact that the can body has, at its mouth, a cylindrical neck in which the dispenser valve is inserted; the valve has a cup-like body to which an upper cap is coupled; the cap defines, in cooperation with the cup-like body, a cavity in which a shutter, which protrudes from the upper cap, can move. The cylindrical neck is seamed onto a protruding ridge of the upper cap to sealingly couple the dispenser valve to the can body.

4 Claims, 2 Drawing Sheets

SPRAYING CAN WITH PREASSEMBLED DISPENSER VALVE

BACKGROUND OF THE INVENTION

The present invention relates to a spraying can with a preassembled dispenser valve, for dispensing fluids in general.

As is known, currently commercially available spraying cans with dispenser valve, commonly termed "spray-cans", have a dispenser valve provided with a cup or bottom made of metallic material which is associated with the body of the valve to seam the valve onto the can; the can is appropriately provided with an opening having a folded edge to allow the seaming of the cup or bottom.

Furthermore, with this type of application, in practice the valve body is assembled during the coupling of the bottom to the can.

This embodiment, although commonly in use, presents various drawbacks, the first of which is constituted by the fact that the cup or bottom is a metallic part subjected to various shaping processes which entail considerably high costs which significantly affect the overall cost of the valve.

A further drawback is constituted by the fact that the assembly operations are relatively complicated, with a consequent considerable effect on the cost of the final product.

SUMMARY OF THE INVENTION

A principle aim of the present invention is indeed to eliminate the drawbacks described above by providing a spraying can with a preassembled dispenser valve, for dispensing fluids in general, which allows to eliminate the use of the conventional cup or bottom made of metal, thus contributing to a drastic reduction in the costs related to the valve body.

Within the scope of the above aim, a particular object of the invention is to provide a spraying can wherein it is possible to preassemble the valve body prior to its application to the can, thereby to achieve consequent advantages in terms of production.

A further object of the present invention is to provide a spraying can which can be both used and filled using conventional methods and consequently without altering conventional production cycles.

Another object of the present invention is to provide a spraying can which, by virtue of its distinctive constructive characteristics, is capable of giving the greatest assurances of reliability and safety in use and is furthermore highly competitive from a merely economical point of view.

The above described aim, the objects mentioned, and other objects which will become apparent hereinafter, are achieved by a spraying can with preassembled dispenser valve, for dispensing fluids in general, according to the invention, which comprises a can body with which a dispenser valve is associated, characterized in that said can body has, at its mouth, a cylindrical neck in which said dispenser valve can be inserted; said valve having a cup-like body to which an upper cap is coupled; said cap defining, in cooperation with said cup-like body, a cavity in which a shutter, which protrudes from said upper cap, can move; and said cylindrical neck can be seamed onto said upper cap to sealingly couple said dispenser valve to said can body.

BRIEF DESCRIPTION OF THE DRAWINGS

Further characteristics and advantages of the present invention will become apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 1:
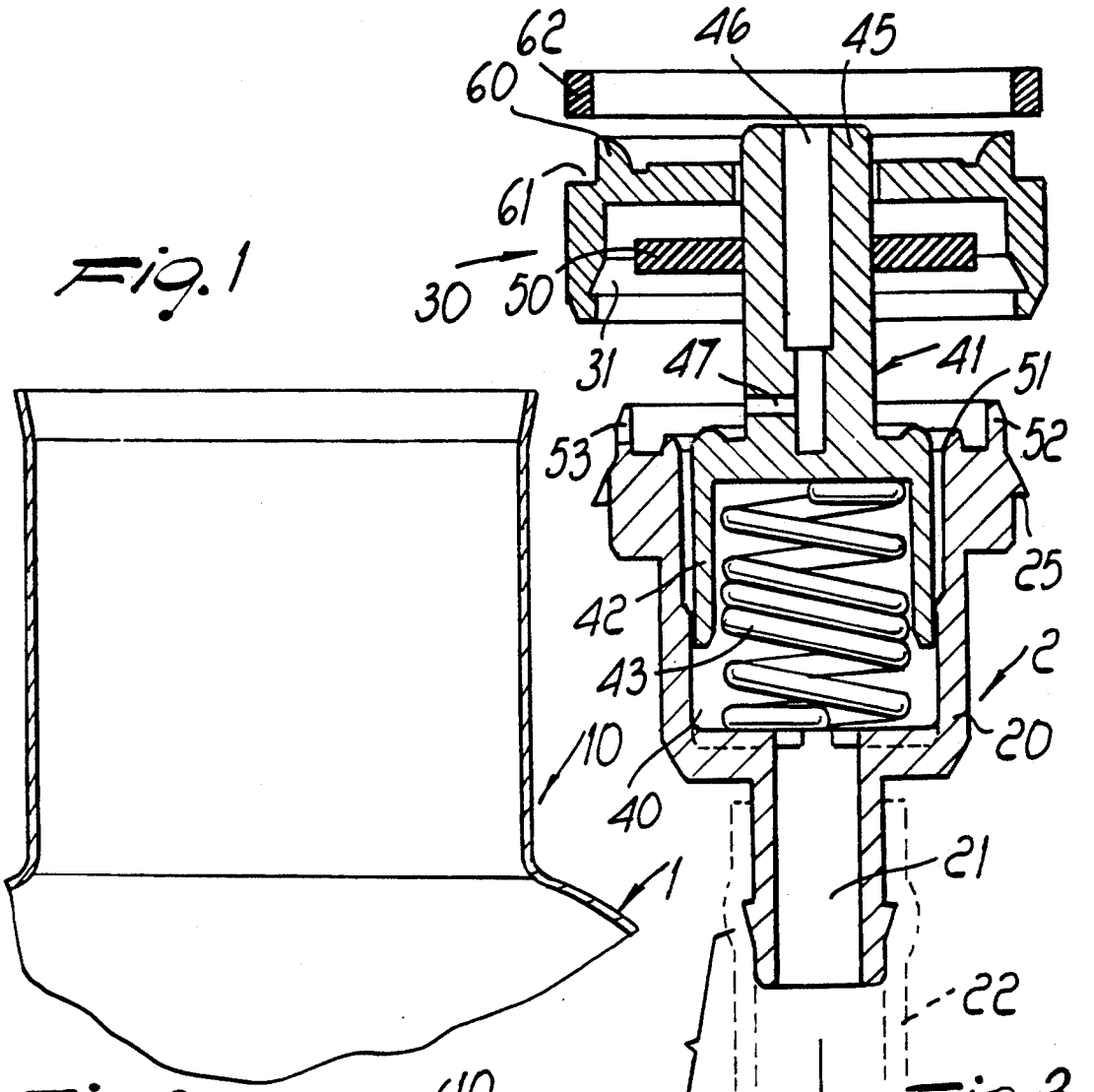
FIG. 1 is a schematic sectional view of the initial configuration of the cylindrical neck of the can body.
Figure 2:
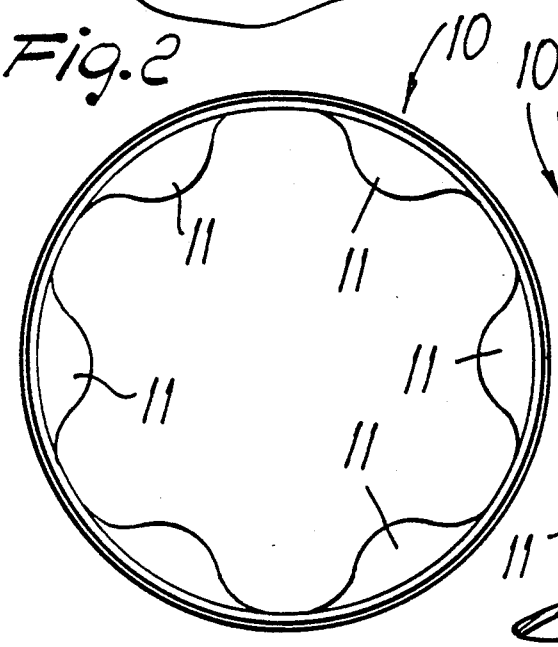
FIG. 2 is a plan view of the cylindrical neck after it has been shaped.
Figure 3:
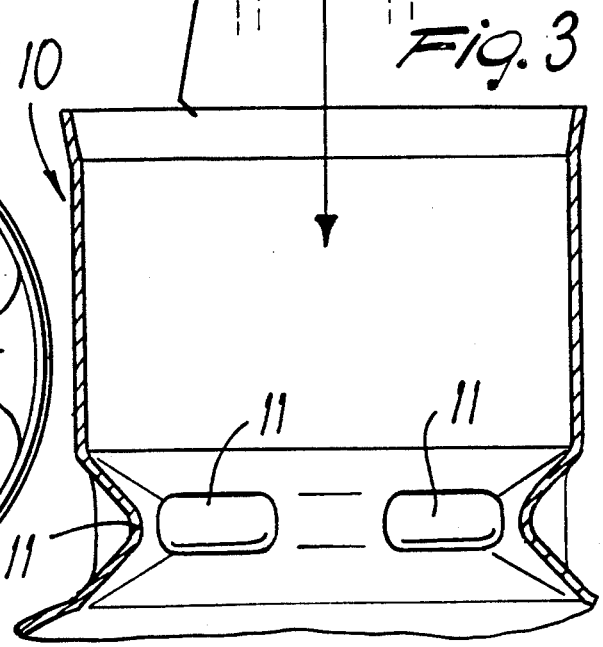
FIG. 3 is a schematic sectional exploded view of the valve body and of the cylindrical neck of the can.

With reference to the above figures, the spraying can with preassembled dispenser valve, for dispensing fluids in general, according to the invention, comprises a can body, generally designated by the reference numeral 1, with which a dispenser valve, generally designated by the reference numeral 2, is associated.

A particularity of the invention is constituted by the fact that the can body 1 is provided, at its mouth, with a cylindrical neck 10 which has, proximate to its region of coupling with the can body 1, shaped indents 11 which are mutually spaced so that they can act as a supporting element, as will become apparent hereinafter, without preventing communication between the can body and the dispenser valve.

The dispenser valve 2 is provided with a cup-like body 20 having a substantially conventional configuration, which is provided downwardly and axially with an inlet 21 upon which is fitted a conventional tube 22 which draws at the bottom of the can.

The cup-like body 20 is provided upwardly, on its lateral surface, with engagement teeth 25 for snap-together coupling in an internal groove 31 of an upper cap 30.

The upper cap 30, in cooperation with the cup-like body 20, defines a cavity 40 in which a substantially conventional shutter element 41 is slidably accommodated; said shutter element is provided with a skirt-like body 42 on which a first end of a pusher spring 43 acts. The pusher spring acts, at its other end, at the bottom of the cavity 40.

A tube 45 of the shutter 41 protrudes from the upper cap 30 through an axial opening thereof; a dispensing duct 46, connected to a radial channel 47, is defined in the tube 45.

Sealing is provided by means of a flat gasket 50 which acts between the internal surface of the upper cap 30 and an annular protrusion 51 defined by the cup-like body, which is furthermore provided with an outer ridge 52 with a conventional discontinuity 53 to allow the loading of the fluid.

Figure 4:
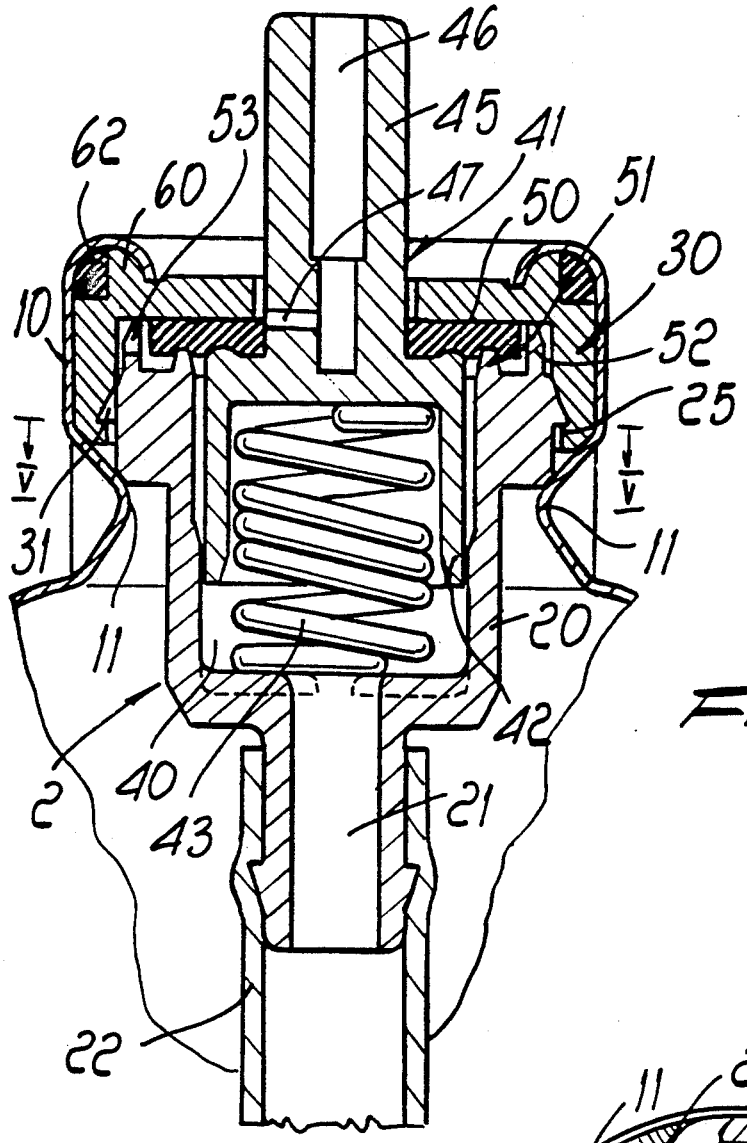
FIG. 4 is a sectional view of the dispenser valve coupled to the can body.
Figure 5:
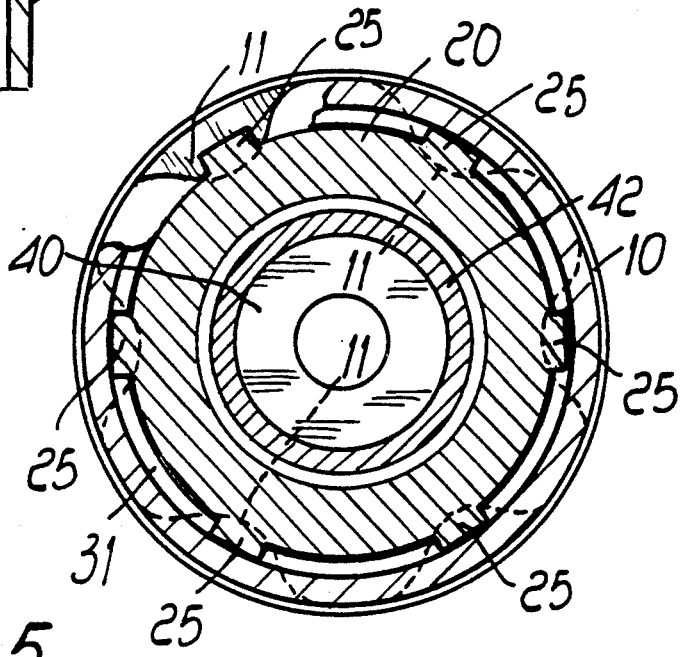
FIG. 5 is a sectional view taken along the plane V-V of FIG. 4.

As shown in FIG. 4, during closure the radial channel 47 is not in communication with the can, whereas when the button is pressed, the channel 47 becomes connected to the cavity 40, allowing the dispensing action.

An important feature of the invention is constituted by the fact that the assembly of the valve body to the can is performed by folding the upper edge of the cylindrical neck of the can, which is then seamed or clamped at a protruding ridge 60 defined by the upper cap.

The upper cap is furthermore provided with a perimetric recess 61 in which an annular gasket 62 is accommodated; this gasket is compressed during the seaming of the cylindrical neck, thus providing a perfect seal.

From what has been described above it can thus be seen that the invention achieves the intended aim and objects and in particular the fact is stressed that with the spraying can with dispenser valve according to the invention it is possible to eliminate the use of the conventional cup or bottom made of metal which used to be coupled to the valve body, since this function is in practice performed by the cylindrical neck in cooperation with the upper cap, which is already assembled together with the dispenser valve, which is thus completely assembled when it is coupled to the can body.

It should also be noted that the can loading operations are performed in a conventional manner, i.e. using the same equipment normally used with known cans.

The invention thus conceived is susceptible to numerous modifications and variations, all of which are within the scope of the inventive concept.

All the details may furthermore be replaced with other technically equivalent elements.

In practice, the materials employed, as well as the contingent shapes and dimensions, may be any according to the requirements.

I claim:

1. Spraying can with preassembled dispenser valve, for dispensing fluids in general, comprising a can body with which a dispenser valve is associated, wherein said can body has, at its mouth, a cylindrical neck in which said dispenser valve is inserted, said valve having a cup-like body to which an upper cap is coupled, said upper cap defining, in cooperation with said cup-like body, a cavity in which a shutter, which protrudes from said upper cap, can move, said cylindrical neck being seamed onto said upper cap to sealingly coupled said dispenser valve to said can body wherein said cylindrical neck has, proximate to its region of coupling with the can body, shaped indents which are arranged mutually circumferentially spaced and act as a supporting element for said cup-like body, and wherein on said cup-like body, engagement teeth are provided which are arranged radially and which are coupled in a snap-together manner in an internal groove of said upper cap.

2. Spraying can with dispenser valve, according to claim 1, wherein said upper cap defines an upwardly protruding ridge for the seaming of said cylindrical neck.

3. Spraying can with dispenser valve, according to claim 2, wherein a perimetric outer recess is provided at said protruding ridge which acts as seat for an annular gasket which constitutes sealing means for the coupling of said valve body to said can.

4. Spraying can with dispenser valve, according to claim 1, wherein said cylindrical neck has an upper edge which is folded inwardly above and over at least a portion of said upper cap and towards said protruding shutter to thereby seam said cylindrical neck onto said upper cap.

* * * * *